United States Patent [19]

Shepard

[11] 4,016,920

[45] Apr. 12, 1977

[54] FLEXIBLE GUIDING TRACK AND RELEASE MECHANISM FOR AN OVERHEAD ROLLING DOOR ASSEMBLY

[75] Inventor: James N. Shepard, Concord, Calif.

[73] Assignee: United States Steel Corporation, Pittsburgh, Pa.

[22] Filed: May 23, 1975

[21] Appl. No.: 580,387

[52] U.S. Cl. ..... 160/133; 49/457; 160/194; 160/201

[51] Int. Cl.[2] ..... E06B 9/14

[58] Field of Search ..... 160/133, 182, 194, 201, 160/215, 216, 217, 271, 270; 49/454, 456, 457; 16/94 R

[56] References Cited

UNITED STATES PATENTS

| | | | |
|---|---|---|---|
| 1,732,850 | 10/1929 | Levan | 49/457 |
| 2,091,299 | 8/1937 | Bagley et al. | 160/201 X |
| 3,118,702 | 1/1964 | Kale et al. | 160/201 X |
| 3,430,677 | 3/1969 | Pierce | 160/271 X |
| 3,837,041 | 9/1974 | Modert et al. | 160/201 X |

FOREIGN PATENTS OR APPLICATIONS

| | | | |
|---|---|---|---|
| 612,938 | 1/1961 | Canada | 160/201 |

*Primary Examiner*—Philip C. Kannan
*Attorney, Agent, or Firm*—William A. Danchuk

[57] ABSTRACT

A sectional door assembly, of the variety having a plurality of interconnected sections which are movable between a closed position and an open position. A flexible guide track is included on both sides of the door for guiding and supporting the plurality of sections between their respective open and closed positions. The flexible nature of the guide track, as well as the incorporation of a relatively quick release mechanism for retaining the guide track on the door's frame, allows for both minimization of damage to the door sections themselves and the time required to repair the door sections if they are accidentally damaged.

5 Claims, 4 Drawing Figures

FLEXIBLE GUIDING TRACK AND RELEASE MECHANISM FOR AN OVERHEAD ROLLING DOOR ASSEMBLY

BACKGROUND OF THE INVENTION

Sectional and rolling overhead door structures have been used in the past in industrial applications where heavy truck traffic and the like is prevalent. The sectional elements of these doors, most often fabricated from steel, are interconnected or interlocked such that they may be moved between open and closed positions and conveniently stored at the former position by rolling or folding, as is well known. A custom-made rigid steel guide is located on either side of the door for guiding and supporting the sectional elements at and between their respective open and closed positions.

Due to the nature of the traffic common to the industrial sites, where such sectional and rolling overhead structures are employed, there exists the possibility that accidents will occur involving damage to individual elements of the door and to the rigid steel guides associated therewith. When a rolling door is damaged, or when the rigid steel guides are deformed, the door becomes inoperable. In many cases, the door is jammed partially open. In damp situations, prevalent in both winter and summer, this condition results in moisture condensing on product inventory and causing product damage. This is especially drastic in the steel industry where condensation on the product (such as steel coils) causes its subsequent rejection and necessitates its reprocessing at considerable financial loss.

The inoperable state of such doors exists for days and possibly weeks before proper repairs can be made. It is during this time that product damage, and possibly even theft occurs.

SUMMARY OF THE INVENTION

The present invention is addressed to a sectional door assembly, of which the rolling overhead door is an example, including a flexible guide track located on both sides of the door for supporting and guiding the same between its open and closed positions. Additionally, the assembly includes a relatively quick release and securing mechanism for releasably securing the guide track to the frame structure located about the door periphery in such a manner as to provide for the relatively quick removal of the guide track from the frame. As a result, the sectional door elements may be quickly repaired or replaced and the guide track secured to the frame in a much shortened period of time.

The flexible nature of the guide track contributes to the minimizing of damage to the sectional door elements. This is accomplished by permitting the door elements to escape from the guide track when sufficient force is applied by accident to a door element or elements. Optimally, the force necessary to remove the elements from the flexible guide track will be smaller than that required to appreciably distort or ruin the door elements themselves. While particular circumstances may preclude such damage prevention operation of the guide track in some cases, the quick release nature of the securing mechanism for securing the guide track to the door frame provides for the relatively prompt substitution of the damaged door elements and subsequent reassembly of the door structure. Accordingly, the time during which the door structure is inoperable is minimized, thereby decreasing the possibility of product damage or theft during such occurrences.

It is therefore a primary object and feature of the present invention to provide a sectional door assembly including a flexible guide track for permitting the non-damaging removal of a sectional door element or elements from the guide track when the element or elements are accidentally struck with a given amount of force.

It is a general object and feature of the present invention to provide a quick release mechanism for a guide track incorporated within a sectional door assembly which provides for the relatively prompt removal of the guide track from its secured relationship with the door frame located about the periphery of the door opening.

It is another object and feature of the present invention to provide a sectional door assembly including a pair of flexible guide tracks positioned on both lateral sides of the sectional door for both guiding and supporting the plurality of sectional door elements between their respective open and closed positions, the flexible guide track being operative to permit the removal of sectional door elements from the guide track when they are accidentally hit with a sufficient force thereby minimizing damage to the sectional door elements, the guide track or the sectional door assembly as a whole.

Other objects and features of the invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the appended claims. The invention itself, however, both as to its structure and its operation together with the additional objects and advantages thereof will best be understood from the following description of the preferred embodiment when read in conjunction with the accompanying drawings wherein:

DETAILED DESCRIPTION OF THE INVENTION

Figure 1:
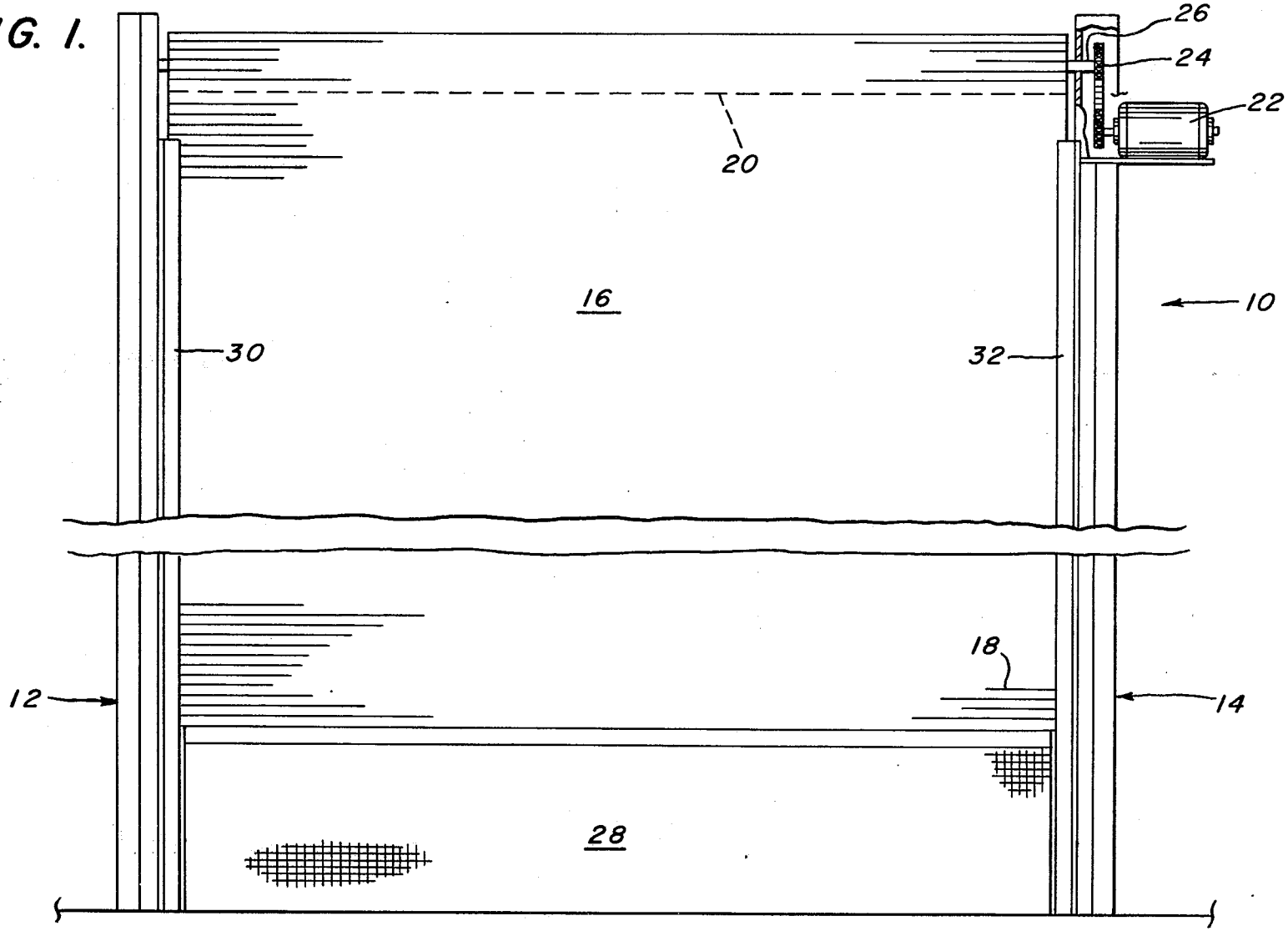
FIG. 1 is an elevational view of the sectional door assembly of the present invention as seen from a position inside a building.

Referring to FIG. 1, there is shown a sectional door assembly 10 which is of the overhead rolling variety. Two frame structures, shown generally at 12 and 14, are located proximate the lateral periphery of an opening with which the door assembly is associated. The assembly 10 includes a door 16 composed of a plurality of interlocking steel slats or elements 18 which are movable between their respective closed positions, as shown in FIG. 1, to their "open" position (not shown) in which the slats 18 are rolled into a convenient storage roll 20 positioned at the top of the door structure.

The specific elements for rolling the slats or door elements into their stored configuration include a motor 22, appropriate gear linkages 24, and a shaft 26 extending between opposite sides of the door opening. Due to the interlocking nature of the slats, as well as the flexible nature of the bottom portion 28 of door 16 (which in this preferred embodiment is a four-ply belt curtain) the door is easily moved to its stored position with a minimum of time and effort.

Support and guidance for the individual door elements is provided through a pair of flexible generally U-shaped guide tracks 30 and 32 located on either side of the door 16. Guide tracks 30 and 32 are attached to frame structures 12 and 14 as will be explained in detail below. In the preferred embodiment, tracks 30 and 32 are made of polyurethane of 90 durometer hardness. It should be apparent that other materials exhibiting a similar degree of flexibility might be used in lieu of polyurethane.

Figure 2:
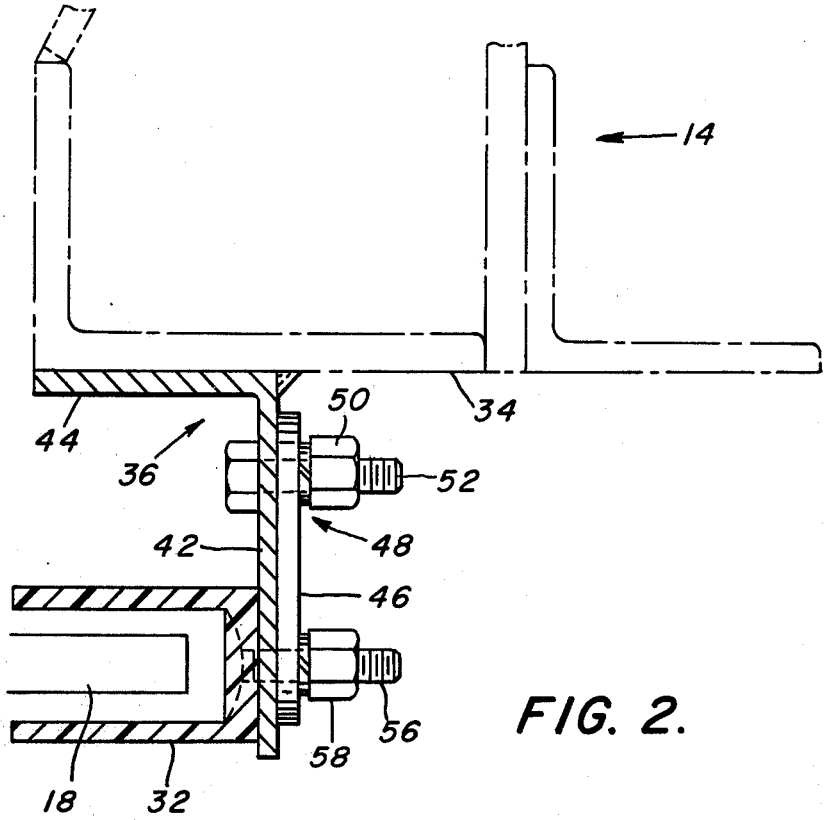
FIG. 2 is a sectional view of a releasable securing mechanism incorporated within the sectional door assembly shown in FIG. 1.
Figure 3:
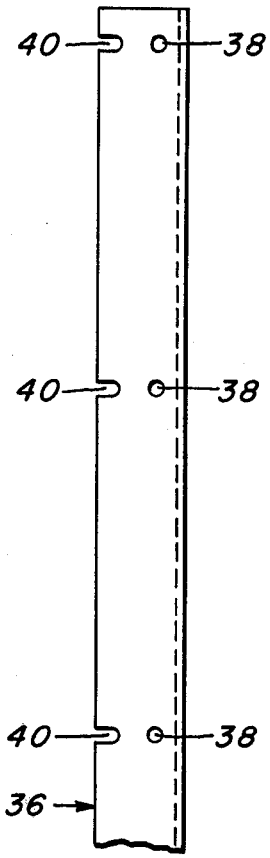
FIG. 3 is an enlarged detailed partial plan view of the releasable securing mechanism of FIG. 2.
Figure 3:
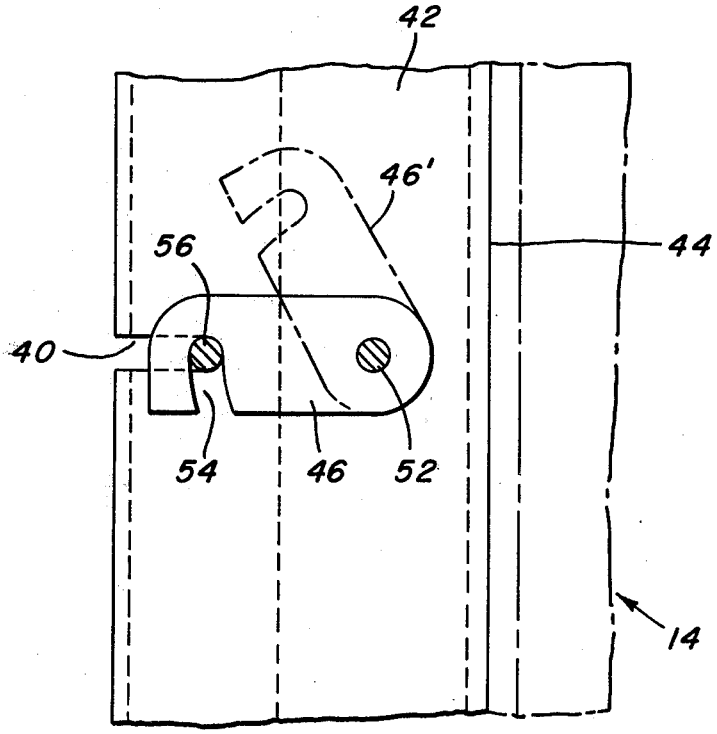
Figure 4:
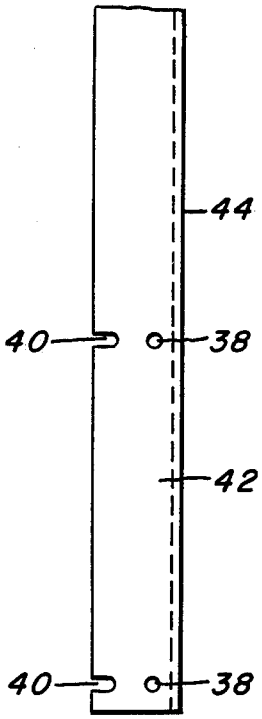
FIG. 4 is a full elevational view of a portion of one element of the releasable securing mechanism of FIG. 2.

Reference is now made to FIGS. 2–4 wherein the specific detail of the guide track-frame interface structure is shown, and in which the "quick" release mechanism of the present invention is disclosed. FIG. 2 is a sectional view of the guide track and frame structure located on the right-hand side of door 16 as seen in FIG. 1. Due to the symmetrical nature of the two door sides, only one will be explained in detail.

The frame structure 14, shown in dashed lines, may take a variety of shapes and/or configurations as will become readily apparent to those skilled in the art. For purposes associated with this invention, it will suffice merely to recite that the frame structure is attached to the periphery of the door opening and provides support for the door supporting and guiding elements which are about to be described. It will aid clarity to the present embodiment to suggest that, in the preferred embodiment of the present invention, frame structure 14 is configured having a supporting wall surface 34 which is parallel to the door 16.

Attached to the surface 34, through any convenient and well known means, such as welding, is an L-shaped frame bracket or member 36. Bracket 36 is configured having an elongated length and includes a plurality of holes 38 and slots 40 formed in and properly spaced along one side 42 extending orthogonal to the plane of the door 16 (see FIG. 4). Should the frame structure 14 be configured having such an orthogonally extending side, then the structure of bracket 36 might be different in order to accommodate for such alterations. However, as presented, bracket 36, which extends at least the full height of the door 16, includes an orthogonal side 42 and a second side 44 oriented normal thereto.

Pivotally mounted to side 42 of bracket 36 is a latch element 46. Latch element 46, mounted to bracket 36 through hole 38 by a nut and bolt arrangement 48, including a nut 50 and bolt 52, is movable between a "latched" position, as shown in solid lines in FIG. 3 to a number of "unlatched" positions, one of which is shown in phantom as at 46'. The latch element 46 basically includes a body having an arcuately shaped slot 54 formed therein as shown. Slot 54 is configured so as to be cooperable with a second bolt 56, which is connected to guide track 32 through a bore formed in the latter as shown in FIG. 2. When inserted within slot 40, the bolt 56, and its associated nut 58, may be "captured" by the arcuate slot 54 of latch element 46. This status is shown in solid lines in FIG. 3.

When the interlocking steel door slats 18 have been accidentally struck, they are displaced, in part, from the guide track 30 and/or 32 due to the latter's flexibility. If the force with which the slats 18 are struck is sufficient to damage them, it may be necessary to replace those door elements before the door can be operated again.

To replace the deformed or damaged slats, the series of two nuts 50 and 58, associated with bolts 52 and 56, respectively, are loosened along the entire length of bracket 36. The latch elements 46 are rotated from their latched positions to their unlatched position as indicated in FIG. 3. Next, the entire guide tracks 30 and 32 and their associated bolts 56 are removed from both sides of the door. The damaged door elements 18 are replaced with elements which have been stockpiled. With the door hanging free, the flexible guide tracks 30 and 22 are then replaced on each side and the bolts 56 are slipped into the slots 40 located in side 42 of bracket 36. Latches 46 are rotated into engagement with bolts 56 such that arcuate slots 54 of all the latches engage and capture bolts 56. Subsequently, nuts 50 and 58 are tightened and reassembly is complete.

It should be apparent that the flexible guide tracks and "quick" release retaining mechanism of the present sectional door assembly provide for several advantages over the prior art. In particular, the flexible guide tracks act as a cushion for any minor impact to the slats such that some damage is alleviated. Additionally, the flexible nature of the guide tracks provides for the release or escape of the slats from the guide tracks without damage to the guides. Moreover, the quick release mechanism for the guide track drastically reduces time required for door repairs by making the entire guide track readily removable. Lastly, the use of standard guide tracks and door slats permits the efficacious stockpiling of guides as well as slats for immediate use should the need arise.

While certain changes may be made in the above system and assembly without departing from the scope of the invention herein involved, it is intended that all matter contained in the above description or shown in the accompanying drawings shall be interpreted as illustrative and not in a limiting sense.

I claim:

1. A sectional door assembly comprising:

means defining a support frame located proximate the periphery of an opening with which said door assembly is associated;

means defining a door composed of a plurality of sections attached to one another such that they are collectively movable between an open position, for permitting entrance and egress through such opening, in which said plurality of sections are conveniently stored out of the path of entrance and egress, and a closed position, for denying entrance and egress, in which said plurality of sections are oriented in stacked parallel abutting fashion to one another for defining a door; and means for supporting and guiding said plurality of sections at their ends at and between said open and closed positions, said supporting and guiding means including a flexible generally U-shaped guide track located on both sides of such opening, said flexible guide track being supported on both sides of such opening substantially totally from the closed end thereof, said guide track having a greater flexibility than said sections, such that one or more of said sections retained within said guide track will be released from said flexible guide track, in either of the two directions which are orthogonal to the plane established by said sections in their closed positions, when a force is applied to said one or more of sections which is otherwise sufficient to flex said sections, said one or more sections being released from said generally U-shaped guide track before said sections are substantially flexed and possible damage results to said one or more sections or to said guide track.

2. The assembly of claim 1 in which said flexible guide track is formed from polyurethane.

3. The assembly of claim 1 in which said supporting and guiding means further includes means for releasably attaching said flexible guide track to said frame defining means such that a quick release of said flexible guide track from said frame defining means may be effected, thereby shortening repair time.

4. A sectional door assembly comprising:

means defining a support frame located proximate the periphery of an opening with which said door assembly is associated, means defining a door composed of a plurality of sections attached to one another such that they are collectively movable between an open position, for permitting entrance and egress through such opening, in which said plurality of sections are conveniently stored out of the path of entrance and egress, and a closed position, for denying entrance and egress, in which said plurality of sections are oriented in stacked parallel abutting fashion to one another for defining a door; and means for supporting and guiding said plurality of sections at their ends at and between said open and closed positions, said supporting and guiding means including a flexible guide track located on both sides of such opening, said flexible guide track being configured to accommodate the forced removal of one or more of said plurality of sections from said guide track with minimum damage to said guide track and said one or more removed sections, said supporting and guiding means further including means for releasably attaching said flexible guide track to said frame defining means including:

extension means, attached to said flexible guide track, and extending from said flexible guide track in such a manner as to provide a convenient extension through which said flexible guide track may be secured while avoiding interference with said supporting and guiding of said plurality of sections at their ends by said flexible guide track, said extension means being insertable within aperture defining means formed in a portion of said frame defining means; and latch means, pivotally mounted to a portion of said frame defining means for movement between a latched position, in which said latch is in latching engagement with said extension means when said extension means is inserted within said aperture, for latching said extension means and said flexible guide track to said frame defining means, and an unlatched position, in which said latch means is out of latching engagement with said extension means such that said extension means, and said associated flexible guide track, may be conveniently and quickly removed from latched association with said frame defining means for effecting repairs to said door defining means or said flexible guide means.

5. A quick release attaching mechanism, for use with a sectional door guide track which supports and guides the elements of a sectional door, for releasably attaching such guide track to a frame located proximate the periphery of an opening with which the sectional door is associated, said quick release attaching mechanism comprising:

extension means, attached to such guide track, and extending from such guide track in a direction so as to provide a convenient extension through which such guide track may be secured while avoiding interference with the guiding and supporting operation of such guide track relative to the sectional door elements, said extension means being insertable within an aperture formed in a portion of such frame; and latch means, pivotally mounted to a portion of the frame for movement between a latched position, in which said latch is in latching engagement with said extension means when said extension means is inserted within the aperture formed in such frame, and an unlatched position, in which said latch means is out of latching engagement with said extension means such that said extension means, and such associated guide track, may be conveniently and quickly removed from latched association with the frame for effecting repairs to the sectional door or to such guide track.

* * * * *

UNITED STATES PATENT OFFICE

CERTIFICATE OF CORRECTION

Patent No. 4,016,920 Dated April 12, 1977

Inventor(s) James N. Shepard

It is certified that error appears in the above-identified patent and that said Letters Patent are hereby corrected as shown below:

Column 4, line 18, change "22" to -- 32 --.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*